US005275453A

United States Patent [19]

Stölzner et al.

[11] Patent Number: 5,275,453

[45] Date of Patent: Jan. 4, 1994

[54] APPARATUS FOR EXTERNALLY GRASPING SPUN YARN CARRIERS IN SPINNING MACHINES OR TWISTING MACHINES

[75] Inventors: Gerd Stölzner, Urbach; Günter Schulz, Ebersbach/Fils; Martin Maeser, Albershausen, all of Fed. Rep. of Germany

[73] Assignee: Zinser Textilmaschinen GmbH, Ebersbach/Fils, Fed. Rep. of Germany

[21] Appl. No.: 910,614

[22] Filed: Jul. 8, 1992

[30] Foreign Application Priority Data

Jul. 10, 1991 [DE] Fed. Rep. of Germany ..... 4122780

[51] Int. Cl.[5] ..... B66C 1/44; D01H 9/02

[52] U.S. Cl. ..... 294/103.1; 57/275; 294/902

[58] Field of Search ..... 294/86.4, 88, 99.1, 294/102.2, 103.1, 119.1, 119.3, 902; 57/270, 274, 275, 281; 81/421-; 116/200, DIG. 41; 269/259, 263, 268, 270, 271, 275, 279-; 279/123; 901/39

[56] References Cited

U.S. PATENT DOCUMENTS

| | | | |
|---|---|---|---|
| 713,189 | 11/1902 | Yates | 269/283 X |
| 1,070,049 | 8/1913 | Machava | 269/282 X |
| 1,283,217 | 10/1918 | Kurtzhals | 81/423 |
| 2,284,449 | 5/1942 | Rodess | 269/283 X |
| 2,814,222 | 11/1957 | Sanders | 81/423 X |
| 2,958,556 | 11/1960 | Samuelson et al. | 294/902 X |
| 3,403,901 | 10/1968 | Servadio | 269/284 X |
| 4,036,001 | 7/1977 | Tamai et al. | 57/275 X |
| 4,341,067 | 7/1982 | Kondo et al. | 294/119.3 X |
| 4,681,210 | 7/1987 | Miki et al. | 294/902 X |
| 5,058,372 | 10/1991 | Staedele et al. | 294/119.3 X |

FOREIGN PATENT DOCUMENTS

| | | | |
|---|---|---|---|
| 2542222 | 7/1976 | Fed. Rep. of Germany . | |
| 2722689 | 11/1978 | Fed. Rep. of Germany | 294/902 |
| 3640002 | 5/1988 | Fed. Rep. of Germany . | |
| 3912332 | 10/1990 | Fed. Rep. of Germany . | |
| 158096 | 12/1982 | German Democratic Rep. | 294/902 |

*Primary Examiner*—Johnny D. Cherry
*Attorney, Agent, or Firm*—Shefte, Pinckney & Sawyer

[57] ABSTRACT

An apparatus for grasping spun yarn carriers in spinning machines or twisting machines is enabled to clamp spun yarn carriers of different nominal diameter ranges by the provision of a stationary clamping element formed by a common holder and a set of detachable interchangeable clamping elements selectively mountable to and demountable from the holder. Each of the interchangeable clamping elements is associated with a specific predetermined nominal diameter range of spun yarn carriers.

6 Claims, 2 Drawing Sheets

APPARATUS FOR EXTERNALLY GRASPING SPUN YARN CARRIERS IN SPINNING MACHINES OR TWISTING MACHINES

BACKGROUND OF THE INVENTION

The present invention relates to an apparatus for externally grasping spun yarn carriers in spinning machines or twisting machines and, more particularly, to grasping apparatus equipped with a movable clamping arrangement and a stationary clamping arrangement whose clamping surfaces are oriented with respect to the axis of a machine spindle or pin for receiving the spun yarn carrier.

A cop removal device is known from German Patent Publication DE-AS 24 42 222 in which a stationary clamping element consists of a ring whose diameter is greater than the diameter of the cop tube to be removed. A piston with a frontally arranged clamping surface is movable radially in the direction of the axis of the ring to form an adjustable clamping element. In the operating position, the ring is guided over the cop until the desired clamping position has been reached. The cop is subsequently clamped by means of moving the piston between its clamping surface and the inner side of the ring located opposite the piston.

German Patent Publication DE-OS 36 40 002 teaches a disk-shaped grasping device with two integrated grasping elements. Each grasping element is provided with a vertical recess configured to be approximately circular for receiving a yarn carrier and on whose circumference two stationary clamping elements staggered by 120° are located. A movable clamping element which constitutes a component of a pneumatically adjustable piston is associated with the stationary clamping elements and has a clamping surface staggered by a further 120° spacing therefrom. When the spun yarn carrier is grasped, the movable clamping element is moved in the direction of the spun yarn carrier located in the recess and this carrier is clamped between the stationary clamping elements and the clamping surface of the movable clamping element.

SUMMARY OF THE INVENTION

The present invention has the object of providing an inexpensive and simple apparatus for externally grasping spun yarn carriers in spinning machines or twisting machines which permits a satisfactory centering of spun yarn carriers with different diameters.

The present invention achieves this objective in a grasping apparatus of the type having stationary and movable clamping arrangements by providing the stationary clamping arrangement with a common holder and a set of selectively interchangeable clamping elements which have identical respective fastening means for corresponding selective attachment and detachment of any one thereof to and from the holder and which also have respective differing clamping surfaces which provide differing spacings from the spindle axis of the spinning or twisting machine when mounted to the holder, thereby to accommodate carriers of differing sizes.

Thus, the present invention provides a grasping apparatus which makes it possible to clamp different nominal diameter ranges of spun yarn carriers and to hold them in a centered position by associating a specific nominal diameter range with a corresponding detachable clamping element which can be replaced in the common holder in a simple manner.

Advantageously, the interchangeable clamping elements may be formed of plastic, which makes it possible to produce the detachable elements in an economical fashion, e.g. by means of an injection molding method. The interchangeable clamping elements can also be made available in differing colors by using colored plastic granulates.

According to another advantageous development of the present invention, the interchangeable elements of the stationary clamping arrangement are each formed with two planar clamping surfaces inclined toward each other, which assures an exact centering of the spun yarn carriers to be clamped.

Preferably, the holder of the stationary clamping arrangement comprises a pocket-shaped receiver for the interchangeable clamping elements. Such a holder makes it a simple possibility to fasten the interchangeable clamping elements in the holder in a simple manner.

In a further aspect of the invention, each interchangeable clamping element comprises a projection which extends out of the holder when mounted therein, which makes possible an identification of the interchangeable element mounted in the grasping apparatus, e.g. by means of optical sensors, even during operation.

In a preferred embodiment of the invention, the interchangeable elements of a common nominal diameter range have the same color among themselves and differ in color from the interchangeable elements of another different nominal diameter range. This feature makes it possible without complication to unambiguously identify and distinguish the interchangeable elements according to the nominal diameter range of the respective yarn carriers for which they are to be used.

DESCRIPTION OF THE PREFERRED EMBODIMENT

Figure 1:
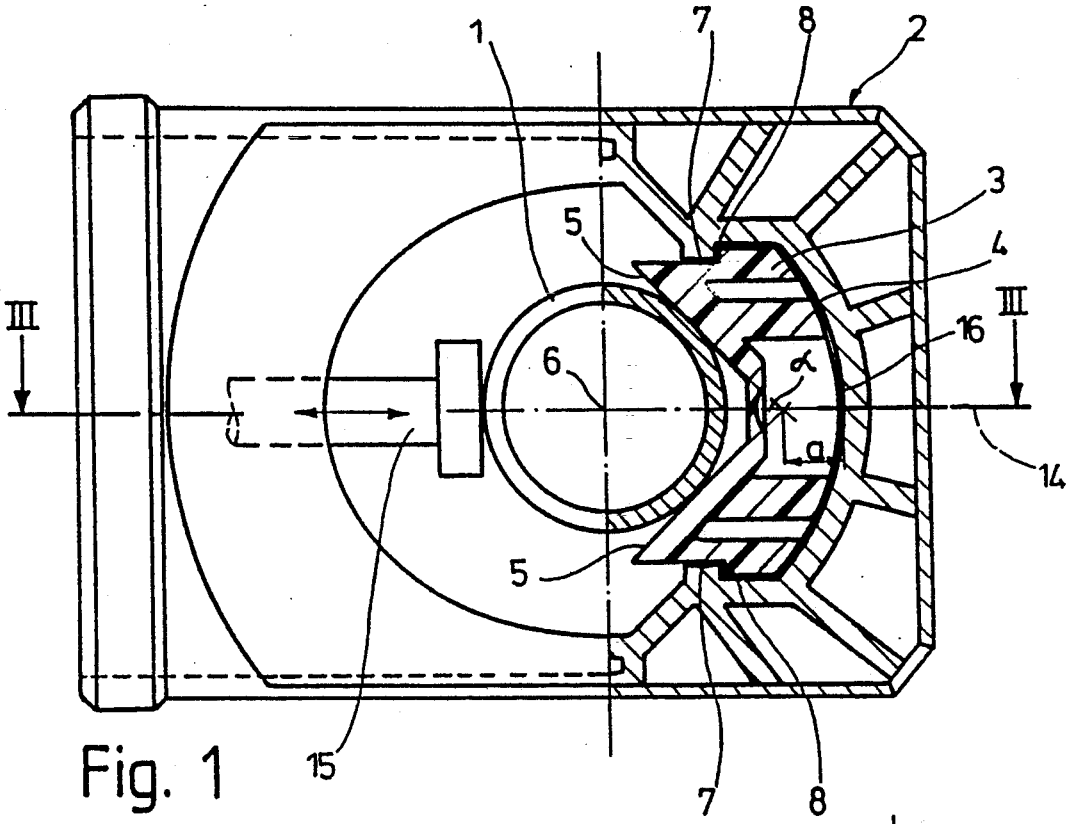
FIG. 1 is a top plan view of a grasping apparatus in accordance with the present invention, shown partially sectioned along line I—I of FIG. 3, with a clamped spun yarn carrier.

A grasping apparatus in accordance with the present invention is shown in the drawing figures and comprises a stationary clamping arrangement 2,3 and a movable clamping arrangement 15 which can cooperatively grasp a spun yarn carrier 1, e.g. a tube in the illustrated example, between themselves and can hold it fast in a clamping fashion.

The stationary clamping arrangement is formed by a common holder 2 integrated in the structure of the external grasping apparatus and by a detachable clamping element 3. The holder 2 comprises a pocket-shaped receiver 4 into which the detachable element 3 is inserted, as is shown in FIG. 1. The contour of the detachable clamping element 3 on the inwardly facing side thereof engaging the holder 2 corresponds to the contour of pocket-shaped receiver 4. The detachable clamping element 3 comprises two planar clamping surfaces 5 inclined toward one another on the opposite outward side of the element facing the spun yarn carrier 1, which surfaces are oriented at an angle o to define a tube receiving area. The clamping surfaces 5 of the detachable clamping element 3 are arranged symmetrically and extend in parallel to the centering axis 6 of a spindle or pin provided on a textile spinning or twisting machine (not shown) for receiving the spun yarn carrier 1.

The pocket-shaped receiver 4 comprises a vertical rib 7 on each of its opposite side surfaces. The detachable clamping element 3 comprises a stop shoulder 8 on both sides corresponding to the ribs 7. A stop 9 (FIG. 3) in the holder 2 serves to position the detachable clamping element 3 in a horizontal plane. A sloping guide surface 10 extends from the lower ends of the clamping surfaces 5 and is inclined toward the receiver 4 to serve both to center the spun yarn carrier 1 and to guide it toward the clamping surfaces 5. The guide surface 10 comprises a detent nose 11 on its downward end at the side thereof engaging the holder 2. In correspondence thereto, the pocket-shaped receiver 4 comprises a horizontal rib 12 extending across the receiver 4. The profiled configuration of the detachable element 3 visible in the drawings renders it elastically deformable in a vertical direction so that the detent nose 11 can engage behind the rib 12, which locks the detachable element 3 in a fixed position in the holder 2 to prevent it from sliding out.

Figure 3:
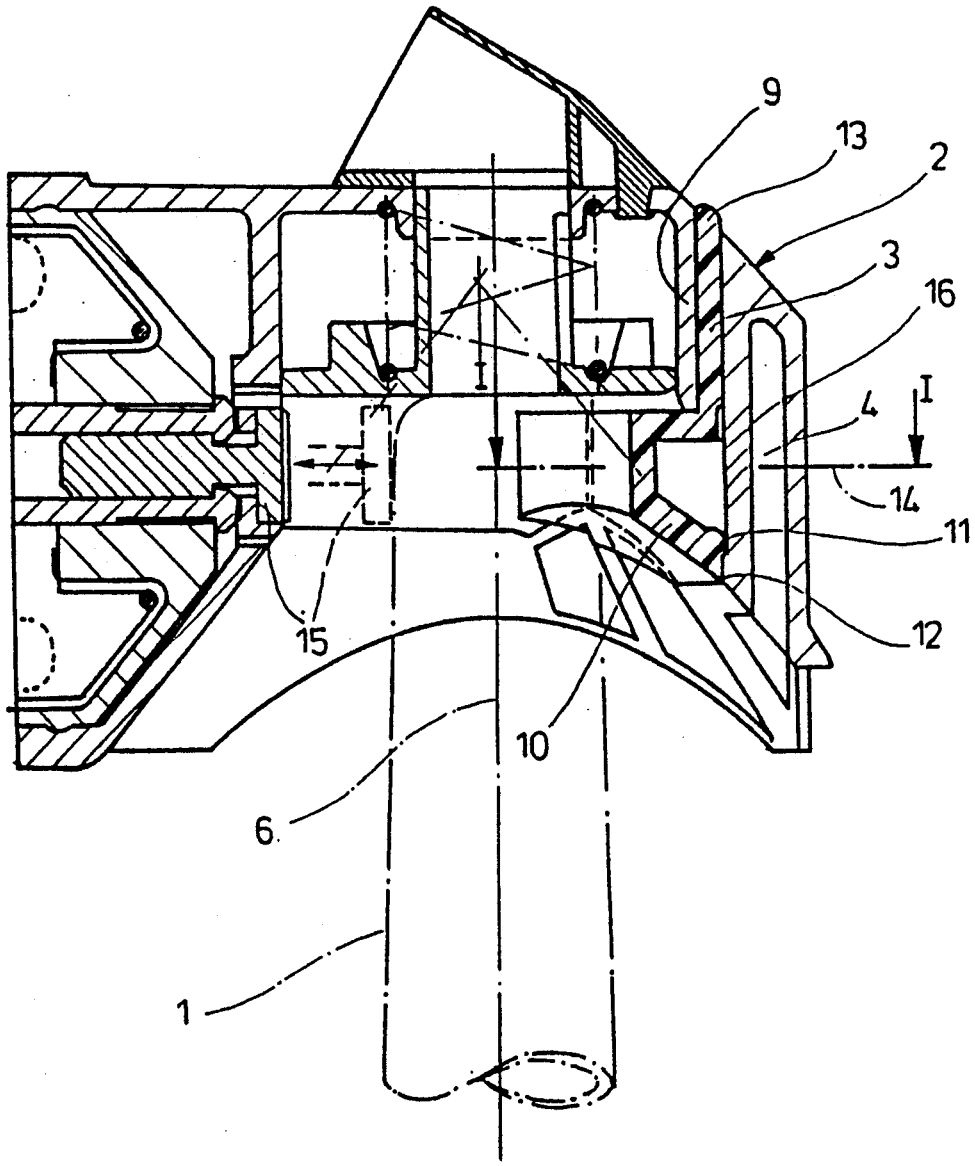
FIG. 3 is a vertical sectional view of the grasping apparatus of FIG. 1 taken along line III—III in FIG. 1.

A projection 13 of the detachable element 3 extends out of the holder 2, as shown in FIG. 3, to enable the detachable element 3 to be identified while locked in the grasping apparatus.

The movable clamping element 15 is reciprocable, e.g. pneumatically, in the direction of the axis of symmetry 14 of the detachable element 3 from opposite the stationary clamping arrangement 2,3 between an initial retracted position, shown in full lines in FIG. 3, which permits the grasping apparatus to receive spun yarn carriers 1 of a predetermined maximum diameter, and an extended clamping position, shown in broken lines in FIG. 3 and full lines in FIG. 1, wherein a yarn carrier received by the grasping apparatus is clamped between the movable and stationary clamping elements 15,3. Notably, a certain additional range of clamping movement must be possible in the case of spun yarn carriers 1 with a maximum diameter in order to assure that the grasping apparatus can reliably operate on the spun yarn carrier 1.

The example shown in FIGS. 1 and 3 relates to a detachable element 3 for yarn carriers 1 of a nominal diameter in the range of 26 to 28 mm. For such yarn carriers, an angle $\alpha$ of 90° was selected for the orientation of clamping surfaces 5. The spacing between the centering spindle axis 6 and the inner bottom surface 16 of the pocket-shaped receiver 4 is fixed at 34 mm in the illustrated embodiment. If an average nominal carrier diameter of 27 mm is taken as a base reference, a spacing a of approximately 15 mm results thereby between the point of intersection of the planes of the angularly oriented clamping surfaces 5 and the bottom surface of the receiver 4.

In order to clamp spun yarn carriers 1 of differing nominal diameter ranges with a single grasping apparatus, various types of the detachable clamping elements 3 can be interchangeably inserted into holder 2. The interchangeable clamping elements 3 differ from each other either by differing configurations which achieve different spacings a between the point of intersection of the clamping surfaces 5 and bottom surface 16 of the pocket-shaped receiver 4 or by means of different angles $\alpha$. A variation between the spacing a and the angle $\alpha$ is also within the scope of the invention.

A decrease in the spacing a with a constant angle $\alpha$ results in an increase of the nominal diameter range of spun yarn carriers which are clampable by the grasping apparatus. A corresponding increase of the spacing produces a decrease of the clampable nominal diameter range for spun yarn carriers.

Likewise, an increase of the angle $\alpha$ with a constant spacing a results in an increase of the clampable nominal diameter range for spun yarn carriers, while a corresponding decrease of the spacing a produces a decrease of the clampable nominal diameter range for yarn carriers.

Even in the case of a variation of both the angle $\alpha$ and the spacing a, there is the result that an increase of the angle $\alpha$ with a simultaneous decrease of the spacing a results in an increase of the nominal diameter range of yarn carriers which are clampable and a decrease of the angle $\alpha$ with a simultaneous increase of the spacing a results in a smaller clampable nominal diameter range for yarn carriers. In the case of other mixed variants, e.g., an increase of the angle $\alpha$ simultaneously with an increase of the spacing a, the resulting clampable nominal diameter range for yarn carriers, in accordance with the above description, depends on the amount of change in each parameter and, particularly, which parameter receives the more significant change.

The varying of the angular position of clamping surfaces 5 is limited to a maximum angle at which the opposite sides of the detachable element 3 can still be formed with shoulder stops 8 for engagement with the ribs 7 and at which the spun yarn carrier 1 will rest in the clamping position on the clamping surfaces 5 and not on the ribs 7.

Figure 2:
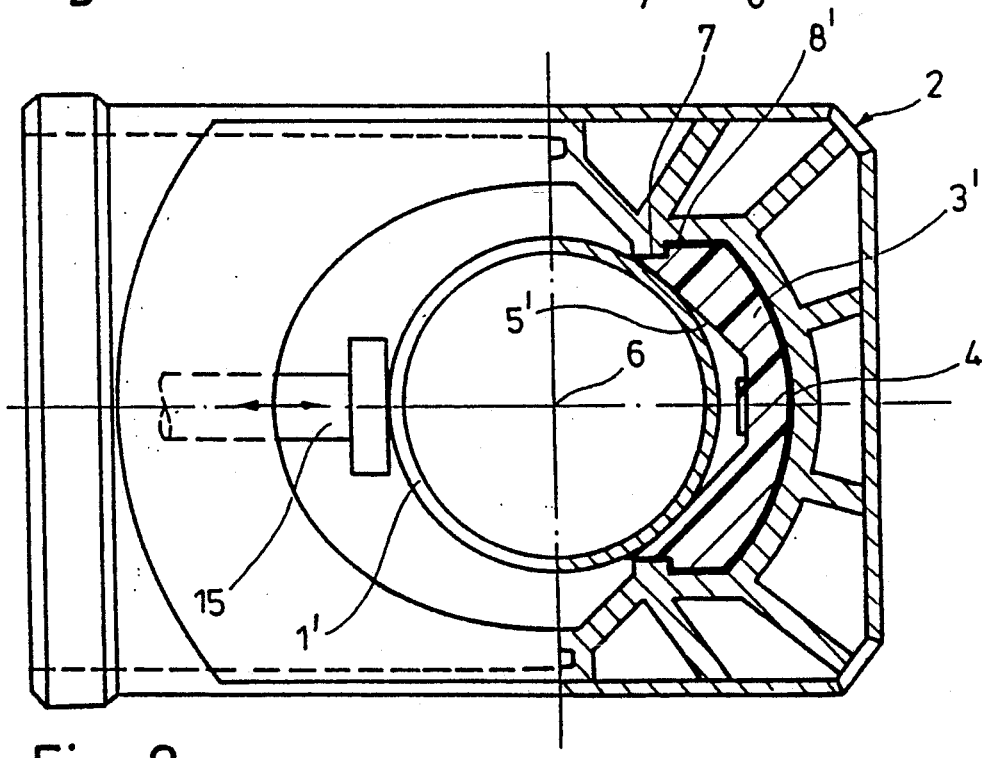
FIG. 2 is another partially sectioned top plan view of the grasping apparatus of the present invention, similar to FIG. 1, showing a different clamping element in use clamping a spun yarn carrier of a differing diameter from FIG. 1.

FIG. 2 shows the clamping apparatus of FIGS. 1 and 3 with another detachable clamping element 3' interchanged for the clamping element 3 to render the apparatus capable for receiving spun yarn carriers 1' with a maximum nominal diameter. The detachable element 3' differs essentially from that of FIGS. 1 and 3 in that it comprises clamping surfaces 5' which exhibit a greater spacing from the centering axis 6 of the spindle (not shown) than the clamping surfaces 5 of detachable element 3. As a result of this increased spacing of the clamping surfaces 5', the grasping apparatus can grasp spun yarn carriers 1 with a maximum diameter without the center line of the apparatus drifting in relation to centering axis 6 of the spindle. The attachment of the detachable element 3' to the holder 2 takes place basically in the same manner as described above in the embodiment of FIG. 1.

During the mounting of either interchangeable clamping elements 3 or 3' in the holder 2, a projection 13 of the clamping element 3 or 3' is initially inserted into a receiving slot of the holder 2 corresponding to the projection 13 and the detachable element 3 or 3' is then pushed in against the stop 9. The detachable element 3 or 3' is guided and positioned by the ribs 7 during the insertion procedure.

As a result of the aforementioned elasticity of the interchangeable elements 3,3', the detent nose 11 can engage behind the rib 12, which prevents a vertical displacement of the clamping element 3,3' from holder 2.

In operation, the grasping apparatus is guided over the end of a spun yarn carrier 1 or 1' on the spindle of the spinning or twisting machine. The sloping guide surface 10 is thereby engaged on the end edge of the spun yarn carrier 1 or 1', causing it to be guided and centered against the clamping surfaces 5 or 5' of the clamping element 3 or 3'. Then, the movable clamping element 15 is reciprocated toward the clamping element 3 or 3' and, as a result thereof, the spun yarn carrier 1 or 1' is clamped and thereby can be lifted off the spindle or pin (not shown) or can be set onto a pin.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In an apparatus for externally grasping spun yarn carriers in textile spinning machines or twisting machines, wherein each spun yarn carrier has a respective carrier axis and said grasping apparatus comprises a movable clamping means and a stationary clamping means having respective clamping surfaces which are oriented toward an axis of a spindle for receiving the spun yarn carrier, the improvement comprising the stationary clamping means including a common holder and a set of selectively interchangeable clamping elements, said clamping elements having identical respective fastening means for corresponding selective attachment and detachment of any one thereof to and from the holder and having differing respective clamping surfaces which provide different predetermined spacings from the spindle axis when mounted to the holder for repeatable uniform clamping positioning of carriers of respectively differing sizes with their respective carrier axes in a common position in alignment with the spindle axis.

2. The improvement in a grasping apparatus according to claim 1, wherein the interchangeable clamping elements are formed of plastic.

3. The improvement in a grasping apparatus according to claim 1, wherein each interchangeable clamping element comprises two planar clamping surfaces which are inclined toward each other.

4. The improvement in a grasping apparatus according to claim 1, wherein the holder of the stationary clamping means comprises a pocket-shaped receiver for the interchangeable clamping elements.

5. The improvement in a grasping apparatus according to claim 1, wherein each of the interchangeable clamping elements comprises a projection which extends in the same position from the holder when mounted thereto.

6. The improvement in a grasping apparatus according to claim 1, wherein the interchangeable clamping elements are of differing colors for distinguishing therebetween according to the differing sizes of the respective yarn carriers for which they are to be used.

* * * * *